United States Patent [19]

Chailleux

[11] Patent Number: 4,674,256

[45] Date of Patent: Jun. 23, 1987

[54] MEMBERS FOR LOAD-CARRYING SPATIAL STRUCTURE

[75] Inventor: Georges Chailleux, Chevry-Cossigny, France

[73] Assignee: Cedegur Societe De Transformation De L'Aluminum Pechiney, Cedex, France

[21] Appl. No.: 611,183

[22] Filed: May 17, 1984

[30] Foreign Application Priority Data

May 17, 1983 [FR] France ..... 83 08543
Apr. 16, 1984 [FR] France ..... 84 06165

[51] Int. Cl.[4] ..... E04H 12/06

[52] U.S. Cl. ..... 52/648; 52/646; 403/171

[58] Field of Search ..... 52/720, 283, 646, 727, 52/650, 648, 656; 403/171, 172, 176, 299, 343

[56] References Cited

U.S. PATENT DOCUMENTS

| | | | |
|---|---|---|---|
| 470,237 | 3/1892 | Freeman | 138/115 X |
| 726,801 | 4/1903 | Maxwell | 52/720 X |
| 1,677,714 | 7/1928 | Frease | 138/115 |
| 2,097,600 | 11/1937 | Pavlecka | 138/115 |
| 3,110,754 | 11/1963 | Witort et al. | 138/115 X |
| 3,592,493 | 7/1971 | Goose | 52/656 X |
| 3,779,282 | 12/1973 | Klees | 138/115 X |
| 3,914,060 | 10/1975 | Miller et al. | 403/171 |
| 4,027,449 | 6/1977 | Cilveti | 52/648 |
| 4,036,371 | 7/1977 | Michel | 403/171 X |
| 4,183,190 | 1/1980 | Bance | 52/648 |
| 4,353,662 | 10/1982 | Du Chateau | 403/171 |
| 4,438,615 | 3/1984 | Wendel | 403/171 X |
| 4,458,455 | 7/1984 | Toll Stoff De Voss | 52/40 X |
| 4,496,823 | 1/1985 | Mann | 138/115 X |

FOREIGN PATENT DOCUMENTS

| | | | |
|---|---|---|---|
| 2452628 | 10/1980 | France . | |
| 285720 | 2/1965 | Netherlands | 52/720 |

*Primary Examiner*—William F. Pate, III
*Assistant Examiner*—Richard E. Chilcot
*Attorney, Agent, or Firm*—Oblon, Fisher, Spivak, McClelland & Maier

[57] ABSTRACT

The invention relates to members constituting the elements of a load-carrying spatial structure. These members, which can have any cross section, have a central circular channel (3) projecting at least at one end for fastening to the corresponding joint element. In a variant, the members can have several axial channels. An element made from these members can also be used as a part for an intermediate connection between a simple tubular member and the joint of the structure.

1 Claim, 9 Drawing Figures

MEMBERS FOR LOAD-CARRYING SPATIAL STRUCTURE

BACKGROUND OF THE INVENTION

1. Field of the Invention

The present invention relates to members constituting the elements of a load-carrying spatial structure.

2. Description of the Prior Art

Known spacial structures, such as scaffolding, flooring, frameworks, domes, etc., consist of tubular members fastened, for example, by axial screwing of parts or tips welded to the members to cooperate with joint elements having corresponding threading; see, for example, French Pat. No. 2 452 628. The tips can have a cylindrical or tapered shape.

Such prior art has the following drawbacks:

1. The operations of welding the threaded tip to the end of a tube are delicate and generally cannot be done on site with sufficient reliability, 2. The dimensions of these tips are a function of the diameters of the tubular members and so are very variable, which requires a minimum stock of tips to make all the assemblies required, 3. The length of the tubes must be established in advance as a function of the exact spacing of the joints to be made, before fastening of the tips.

Further, spatial structures are known which consist of circular-shaped tubular members whose function is to withstand longitudinal tensile or compression stresses (U.S. Pat. No. 4,183,190).

However, in most practical uses the members support, in addition to axial stresses, bending stresses, often in a preferential direction (for example, vertical in the case of gravity). Shapes, generally other than circular, exhibiting a shape and moment of inertia suited to the stresses experienced, are generally used to save material.

On the other hand, connections of these members to the joints are made at a plane-end surface or at least a spherical surface having a projection equal to the cross section of the cylindrical tube used; this results in very large bulk which reduces the number and/or unit section of the usable members connected to the same joint.

SUMMARY OF THE INVENTION

This invention eliminates these difficulties by using members whose cross section, of whatever shape, has a central circular channel. At least one of the ends of each of the members is tapered to project said central channel, for example, in a conical or pyramidal shape. In this way, the bulk in the vicinity of the joints is limited, without resorting to a specific part added by welding or any other connecting means, such as that described in French Pat. No. 2 452 628.

This arrangement further facilitates fixing of the axial fastening screw, once it is put in place, by elliptically deforming the central channel with manual or pneumatic pliers that can be used on site, this being done by exerting a deforming pressure on the channel in two diametrically opposite areas on either side of the screw.

The members according to the invention can also be connecting tips fastened to tubular members whose inside shape is identical to the outside shape of the connecting tip considered. The tips can be straight or machined in tapered members; they are fastened to the tubular shape by welding, gluing or any other means.

This process, however, is better suited to structures prefabricated at the plant.

In the case of load-carrying structures, such as vertical columns and horizontal floors or roofs, the members can have a simple closed tubular shape that is circular or polygonal, or an open section having two or more longitudinal channels. The members may be, for example, a box column of rectangular section, having a channel at each corner or a star with several points each carrying a channel at its ends.

When members are used with a straight-end section, it is very simple to put them in place on site, since all that is required is to:

1. Cut the member to length,
2. Tap the longitudinal channel or channels of the member,
3. Fasten the member to the joint with one (or more) axial screws.

In some cases, the second step can be eliminated by using self-tapping screws.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
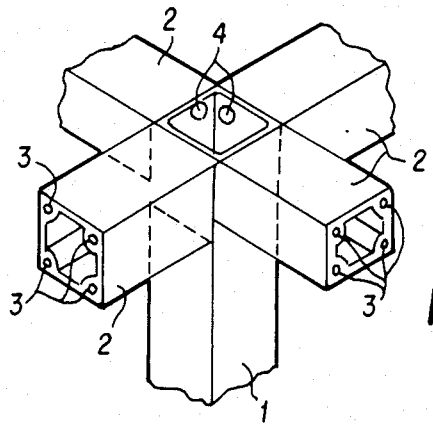
FIG. 1 shows in perspective an assembly of a vertical column and horizontal members according to the invention.

FIG. 1 shows a structure including a rectangular column (1) and horizontal members (2), each having four channels (3) one of the channels being located in each of the inside corners of the member.

Members (2) are fastened to the column (1) by screws (4) which engage in the channels (3) whose ends are tapped.

Figure 2:
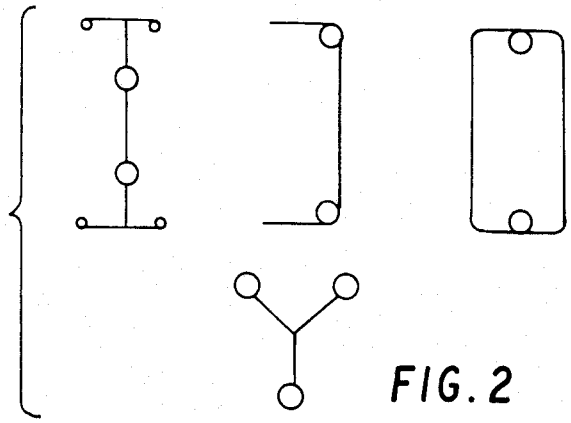
FIG. 2 shows cross sections of various members according to the invention, having several axial channels.

FIG. 2 shows various sections of members exhibiting several longitudinal channels (3).

Figure 3A:
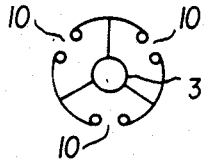
FIGS. 3(1) to 3(3) show an end view of the sections of various members according to the invention, having only a central channel.
Figure 3B:
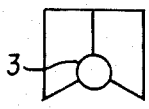
Figure 3C:
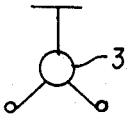

FIG. 3 represents various sections of members exhibiting a deformable, cylindrical, inner surface defining the single elongate central channel (3). In the case of FIG. 3(1), the longitudinal grooves 10 of an outer surface of the member make possible the fastening of various structural elements, such as false ceilings, or the like.

Figure 4:
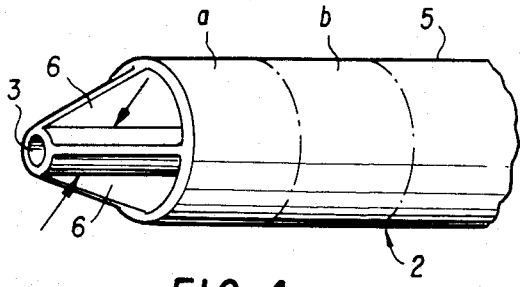
FIG. 4 shows in perspective a tubular member whose cross section is shown in FIG. 5.
Figure 5:
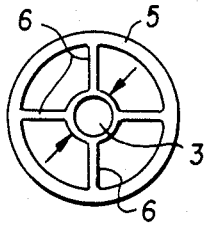
FIG. 5 shows the tubular members of FIG. 4 in section.

FIGS. 4 and 5 show a member according to the invention exhibiting an elongate axial channel 3 formed by an inner surface connected to the cylindrical outer tubular surface shape 5 by four wings (6). The ends of the wings have been beveled like a cone to extend the central channel (3). In this way, the member exhibits a reduced front surface and this permits locking of the fastening screw, once it has been put in place, by exerting deforming pressures on the channel at the placed and directions shown by the arrows.

Figure 6:
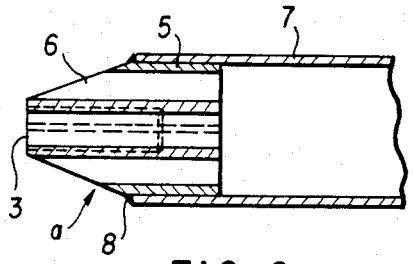
FIGS. 6 and 7 show an axial section of a connecting tip made with the members according to the invention and exhibiting a tapered end according to the invention (FIG. 6) or a straight section (FIG. 7).

FIG. 6 shows a tapered connecting tip (a) made by removal of the part (a) of the member (2) of FIG. 4 and fastening the part (a) to the end of a circular cylindrical tube (7) by the welding bead (8).

Figure 7:
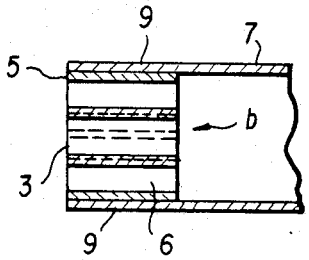

FIG. 7 shows a straight connecting tip (b) made by removal of the part (b) of the member (2) of FIG. 4 and fastening the part (b) by gluing at (9) to the end of a tube (7).

Obviously, numerous modifications and variations of the present invention are possible in light of the above teachings. It is therefore to be understood that within the scope of the appended claims, the invention may be practiced otherwise than as specifically described herein.

We claim:

1. In a reticular spatial structure, an element comprising:

a deformable cylindrical inner surface defining an elongate central channel therein;

an outer surface having a predetermined profile and extending around said inner surface coaxial with an axis of said channel;

a plurality of radially extending wing means for connecting said inner and outer surfaces such that one end of said inner surface projects out from said outer surface in an axial direction, wherein said connecting wing means are tapered at said one end to form a tapered projection;

a tubular member having an inner surface with said predetermined profile, wherein said outer surface is fixed in said tubular member with said tapered projection projecting therefrom.

* * * * *